US005852425A

United States Patent [19]

Bird et al.

[11] Patent Number: 5,852,425

[45] Date of Patent: Dec. 22, 1998

[54] ACTIVE MATRIX DISPLAY DEVICES FOR DIGITAL VIDEO SIGNALS AND METHOD FOR DRIVING SUCH

[75] Inventors: Neil Christopher Bird, Horley; Alan George Knapp, Crawley, both of England

[73] Assignee: U.S. Philips Corporation, New York, N.Y.

[21] Appl. No.: 96,626

[22] Filed: Jul. 21, 1993

[30] Foreign Application Priority Data

Aug. 14, 1992 [GB] United Kingdom ..... 9217336

[51] Int. Cl.[6] ..... G09G 3/06

[52] U.S. Cl. ..... 345/92; 345/99

[58] Field of Search ..... 345/87, 92, 99, 345/102

[56] References Cited

U.S. PATENT DOCUMENTS

| | | | |
|---|---|---|---|
| 4,750,813 | 6/1988 | Ohwada et al. | 345/92 |
| 4,881,066 | 11/1989 | Kanno et al. | 345/92 |
| 5,051,739 | 9/1991 | Hayashida et al. | 345/92 |
| 5,095,304 | 3/1992 | Young | 345/92 |

FOREIGN PATENT DOCUMENTS

| | | |
|---|---|---|
| 0289255 | 1/1989 | European Pat. Off. . |
| 0391654 | 10/1990 | European Pat. Off. . |

*Primary Examiner*—Amare Mengistu
*Attorney, Agent, or Firm*—John C. Fox

[57] ABSTRACT

A TFT active matrix display device comprising an array of display elements (12), e.g. LC display elements, each connected to the drain of a TFT (17) whose gate and source are connected respectively to a row conductor (18) to which selection signals are applied by a scan drive circuit (21) and a column conductor (19) to which display data signals are applied by a data signal drive circuit (25) in the form of time dependent signals comprising pulse width modulated signals derived from an input digital video signal and representing video sample values. During the selection period the TFTs are biased to act as current sources such that their associated display elements (12) are charged to a level dependent on the duration of the applied signals. The digital to analogue conversion of the video signal is thus completed at the picture elements. In an initial part of the selection period a reference potential, which alternates between two levels in successive fields, is applied to the column conductors to reset the display elements to a predetermined level.

23 Claims, 6 Drawing Sheets

ACTIVE MATRIX DISPLAY DEVICES FOR DIGITAL VIDEO SIGNALS AND METHOD FOR DRIVING SUCH

BACKGROUND OF THE INVENTION

This invention relates to an active matrix display device comprising sets of row and column conductors, an array of display elements, each comprising first and second electrodes with electro-optical material therebetween, the first electrodes being connected to the drain of a TFT whose source and gate are connected respectively to a column conductor and a row conductor, and drive means comprising a scan drive circuit for applying selection signals to the row conductors, and a data signal drive circuit connected to the column conductors which drive circuit includes means for providing time dependent signals representing video information. The invention relates also to a method of operating such a display device.

Active matrix liquid crystal display devices of the above kind are known, both for analogue and digital video signals. Data signal drive circuits operating with digital video signals can offer certain advantages over those operating with analogue video signals, which comprise analogue sample and hold circuits. Particularly in larger area displays having increased numbers of rows and columns of display elements, limitations for example in the operating speeds of these analogue circuits become apparent. Digital video signals can also be advantageous, especially in data-graphic display apparatuses, in that digital video processing circuits can offer greater flexibility than their analogue counterparts. The digital video signal could be supplied for example from a RAM store of a computer. Alternatively, it could be provided by converting analogue TV video signals into digital form.

Examples of such display devices for operating with digital video signals are described in EP-A-0391654 and EP-A-0298255. In the data signal drive circuits described in these specifications, the digital video signals are converted into analogue (amplitude modulated) signals in the data signal drive circuit before being supplied to the column conductors of the display device, and hence to the TFTs associated with the display elements which operate as switches to transfer the analogue voltages to the display elements. This digital to analogue conversion typically involves translating the digital signals into time dependent pulse signals, e.g. pulses whose width are determined by the multibit digital signals, which are used to sample a time-varying reference voltage, either stepped or continuous, so as to obtain output voltages whose amplitudes are determined by the durations of the time dependent signals.

Such digital to analogue conversion complicates the data signal drive circuit. Also the drive circuit is not truly digital but comprises a mixture of digital and analogue components.

OBJECTS AND SUMMARY OF THE INVENTION

It is an object of the present invention to provide an improved display device for displaying input digital video signals.

It is another object of the present invention to provide a display device for operating with digital video signals in which the data signal drive circuit can be simplified and operable at high speeds.

According to one aspect of the present invention, there is provided a method of driving an active matrix display device of the kind having sets of row and column conductors and an array of display elements each comprising first and second electrodes with electro-optical material therebetween, the first electrodes being connected to the drain of a respective TFT whose source and gate are connected respectively to a column and a row conductor, in which selection signals are applied to the row conductors and in which digital video signals are converted into corresponding time dependent signals, characterised in that the time dependent signals are applied to the column conductors and in that during the application of a selection signal to a row of TFTs the TFTs are biased to act as current sources such that their associated display elements are charged to a level dependent on the duration of the applied time dependent signal.

The operation of the TFTs in saturation acting as current sources is quite different from the usual mode of operation of TFTs in conventional active matrix display devices. In conventional TFT type display devices, and similarly those of the aforementioned specifications, the second electrodes of the display elements, usually constituted by respective regions of a continuous electrode common to all display elements, are held at a fixed potential, for example ground, during operation of the display device and the TFTs are operated as simple switches in the linear region of their drain/source current versus drain/source voltage characteristic.

As a result of operating the TFTs as current sources, the amount of charge transferred to the display element upon the TFT being turned on by the application of the selection voltage to its gate is proportional to the length of time over which the time dependent pulse signal is applied to its source. Thus the voltage of the display element following its addressing, and hence the display effect, e.g. grey scale, produced, is dependent on, and determined, by the duration of that signal. Using this technique the conversion of the digital video signals to analogue signals is completed at the display elements. Compared with the display devices described in the aforementioned patent specifications, there is no need to convert the time dependent pulse signals to analogue (amplitude modulated) voltages in the data signal drive circuit before supply to the column conductors. Consequently, the necessary data signal drive circuit is considerably simplified. Importantly, in removing the digital to analogue conversion function, the data signal drive circuit can readily be implemented using purely digital circuitry. This is of particular significance to the integration of the data signal drive circuit on a substrate of the display panel, using for example, TFTs fabricated at the same time as those associated with the display elements, which is difficult to achieve satisfactorily when analogue processing is involved. A digital data signal drive circuit is capable of operating at comparatively high speeds but the presence of analogue circuitry in this circuit imposes limitations. By in effect moving the analogue part of the circuit to the display element array the analogue part is required only to operate at line rate and the high speed capability of the digital data signal drive circuit can be fully exploited.

Another important advantage is that the completion of the D/A conversion process at the location of the TFTs and display elements does not demand any additional components so that the display element aperture remains unaffected.

In one preferred embodiment of the invention, the biasing of the TFTs such that they act as current sources may be achieved conveniently and simply by switching the potential applied to the second electrode of the display elements connected thereto to a level which is greater than the difference between the level of the selection signal applied to their gates and their threshold voltage level. This simplifies the nature of the drive signals required for the row and column conductors. Alternatively, the second electrodes of the display elements could be held at a constant potential level and potential levels applied to the row and column conductors switched appropriately to achieve the desired affect.

Preferably, the period for which the bias level is applied is at least equal to the maximum duration of a time dependent pulse signal and the column conductor is switched to a voltage level substantially corresponding to the level of the selection signal for the remaining duration of the bias level. By simply switching the potential of the column conductor in this way the TFT is turned off even though the selection signal may be present. The application of the bias level is preferably terminated substantially simultaneously with the selection signal. In this way no gap is necessary between addressing successive rows. Preferably, the display elements of a row are reset to a predetermined level during a first part of the selection signal applied to the row concerned and prior to said biasing of the TFTs by applying a reset voltage to the column conductors. Thus, the display elements can be reset in a simple manner as part of a row address period with the reset and display element charging phases of the operating cycle being immediately consecutive and utilizing a single selection signal. Conveniently, the reset voltage may be alternated between two levels for successive fields such that the display elements are charged to positive and negative voltages in alternate fields.

According to another aspect of the present invention, there is provided an active matrix display device comprising sets of row and column conductors, an array of display elements each comprising first and second electrodes with electro-optical material therebetween, the first electrodes being connected to the drain of a respective TFT whose source and gate are connected respectively to a column and a row conductor, and a drive circuit for driving the display elements comprising a scan drive circuit for applying selection signals to the row conductors and a data signal drive circuit connected to the column conductors which includes means for providing time dependent pulse signals representing video information, which is characterised in that the data signal drive circuit is arranged to supply the time dependent pulse signals to the column conductors and includes means for biasing the TFTs during the application thereto of a selection signal such that the TFTs act as current sources.

BRIEF DESCRIPTION OF THE DRAWING

Active matrix display devices and methods of driving such in accordance with the present invention will now be described, by way of example, with reference to the accompanying drawings, in which.

It should be understood that the Figures are merely schematic and are not drawn to scale. It should also be understood that the same reference numerals are used throughout the Figures to indicate the same or similar parts.

DESCRIPTION OF THE PREFERRED EMBODIMENTS

Figure 1:
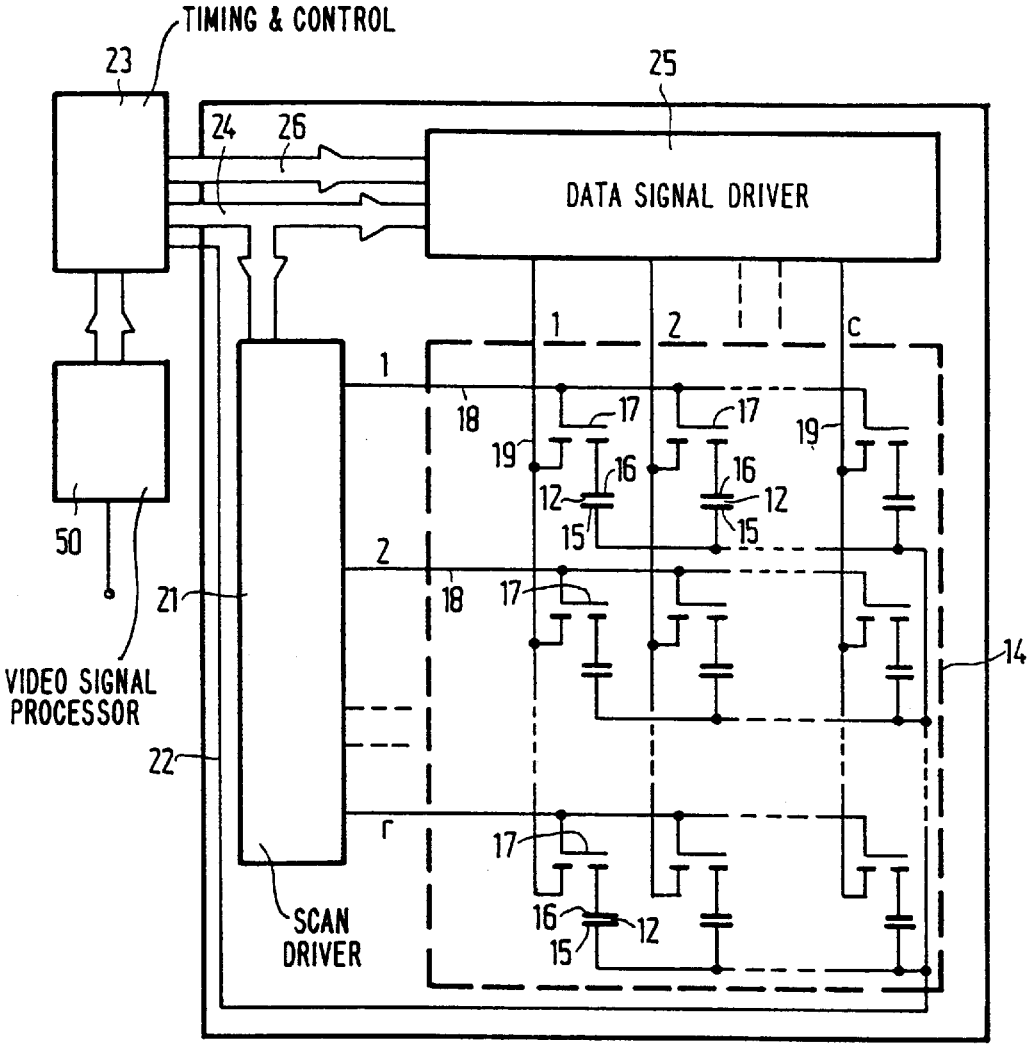
FIG. 1 is a schematic block diagram of an active matrix liquid crystal display device according to the present invention.

Referring to FIG. 1, the active matrix liquid crystal display device comprises a row and column array of liquid crystal display elements 12 defining a display area 14. Each display element 12 comprises a capacitive element consisting of two spaced electrodes carried respectively on the opposing surfaces of two spaced substrates with TN liquid crystal material disposed therebetween. The display element electrodes on the one substrate are constituted by respective regions of a continuous counter electrode layer, denoted 15, common to all display elements in the array. The other electrodes, 16, of the display elements comprise individual electrodes each of which is connected to the drain of an associated TFT 17 carried together with the electrode 16 on the other substrate and through which the display element is driven. The TFTs 17 of the array are addressed via sets of row and column address conductors, 18 and 19, also carried on that substrate, with the associated display elements and TFTs being located adjacent a respective intersection of the row and column conductors. The gates of all TFTs in the same row are connected to a respective row conductor 18 and the sources of all TFTs in a column are connected to a respective column conductor 19. There are r rows and c columns of display elements, providing a total of r.c display elements in the array.

The display element array is driven by peripheral drive means which includes a scan drive circuit 21 which scans the rows of TFTs successively in a known manner, for example, by applying a selection (gating) pulse signal to each of the row conductors 18 in turn, which operation is repeated in successive field periods. The scan drive circuit 21 is of conventional form, comprising for example a digital shift register circuit, and is controlled by timing signals provided from a timing and control circuit 23 along a bus 24 which also supplies the necessary potential levels defining the selection and non-selection signal levels.

The drive means further includes a display data signal drive circuit 25 to which a digital video information signal is applied along a bus 26 and which operates to supply to the set of column conductors 19 appropriately in parallel for each video line in turn data signals in digital form.

The data signal drive circuit comprises a respective stage for each column conductor 19. A block diagram of a typical stage in one embodiment of data signal drive circuit is shown schematically in FIG. 2, which also shows part of the display element array and the row scan drive circuit 21. For simplicity, it is assumed in this example that the display device is a black and white display device. The display device could alternatively be a full colour display device in which a three colour micro-filter array is associated with the display element array. In this case, the data signal drive circuit would be suitably modified to handle separate R, G and B video signal inputs in known manner, for example, using the kind of approach described in EP-A-0391654.

In common with conventional analogue column drive circuits, typically comprising a shift register circuit operating analogue sample and hold circuits, writing of video information to the display element array takes place on a line-by-line (row-by-row) basis in which a line of video information is sampled by the column driver circuit and subsequently written to the display elements in a selected row, the identity of the selected row being determined by the scan drive circuit.

Figure 2:
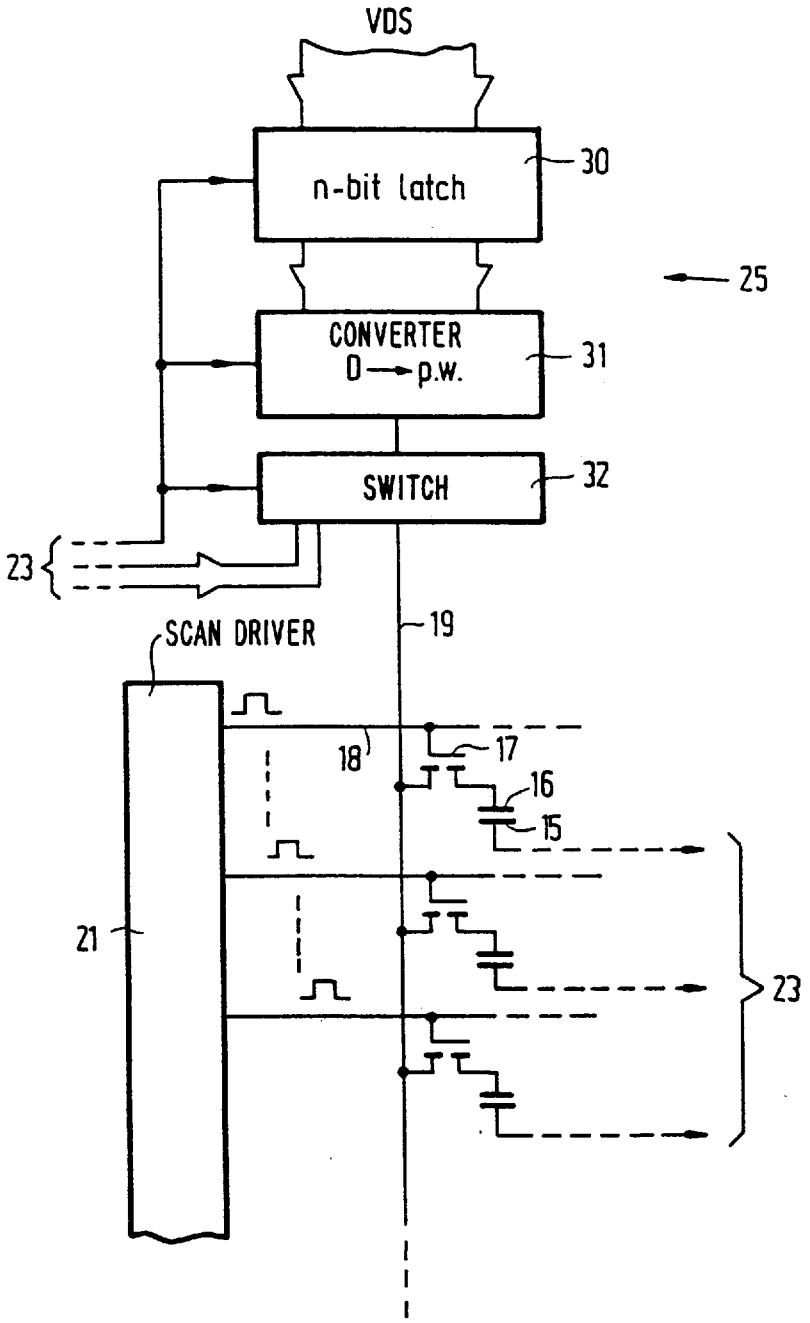
FIG. 2 is a schematic block diagram of a typical stage of a data signal drive circuit of the display device connected to a respective column conductor.

Referring to FIG. 2, a digital video data sample VDS from a line of the applied video information signal and comprising n bits is stored in an n-bit latch circuit 30 whose output is fed to a digital to pulse width converter circuit 31 which provides a time dependent signal comprising a pulse width modulated signal whose duration represents the video signal information. The converter circuit 31 is in turn connected to a switching circuit 32 whose output is supplied to the column conductor 19. The operations of the circuits 30, 31 and 32 are all controlled by timing signals provided by the timing and control circuit 23 which also includes a power supply providing predetermined and constant voltage levels to the switching circuit 32 for reasons which will become apparent.

Figure 3A:
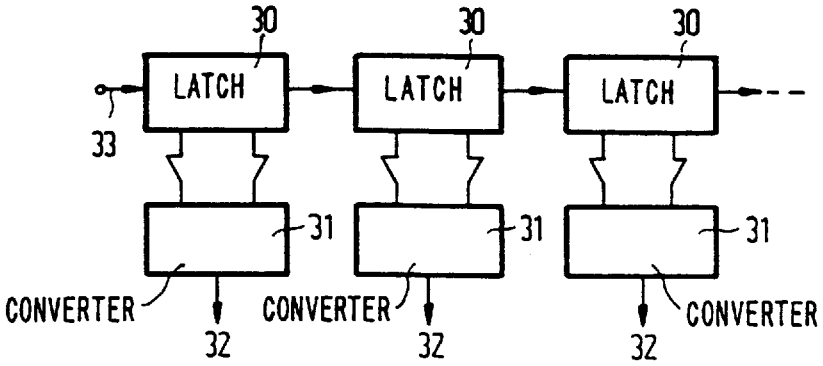
FIGS. 3*a* and 3*b* are schematic block diagrams illustrating alternative approaches to demultiplexing a digital video signal applied to the data signal drive circuit.

The digital video signal applied to the data signal drive circuit 25 requires de-multiplexing so that the samples from a complete line of video information can be stored in the latch circuits 30 as appropriate to their associated column of display elements. Two different ways for achieving this are depicted schematically in FIGS. 3*a* and 3*b*. FIG. 3*a* illustrates a scheme in which a line of video information in serial form is read into the latch circuits 30 along the line 33. The latch circuits are operated as a long shift register and serve to sample the video line and store the sampled information. When the complete video line has been shifted along the register, byte-wide samples are loaded into the converter circuits 31. In the alternative approach of FIG. 3*b*, and as used in the example drive circuit of FIG. 2, a conventional de-multiplexer arrangement 34 is used to transfer byte-wide samples to the appropriate latch circuits 31.

Figure 4:
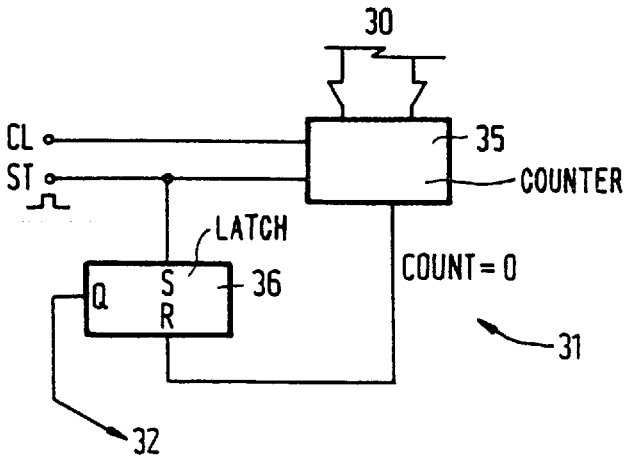
FIG. 4 is a schematic block diagram showing an example of a digital-to-pulse width converter circuit used in the stage of the data signal drive circuit.

The digital-to-pulse width converter circuit 31 can be of various known forms, as will be apparent to persons skilled in the art. An example of one suitable type of circuit is illustrated in FIG. 4. Digital data from the latch circuit 30 is loaded into a presettable n-bit binary counter 35 to which clock and start signals, CL and ST, are supplied from the circuit 23. On receipt of the start flag, the output of the converter circuit is set and the clock signal counts the counter down to zero at which point an output latch 36 is reset to logic "0". The Q output of the latch 36 thus comprises a pulse whose duration (width) is determined by, and represents, the input digital data. This pulse signal is supplied to the switching circuit 32 which provides a corresponding time dependent signal, i.e. pulse-width-modulated signal, whose amplitude is determined by a reference potential supplied to the circuit 32 from the circuit 23 and whose duration corresponds to the duration of the pulse from the converter circuit 31.

Figure 3B:
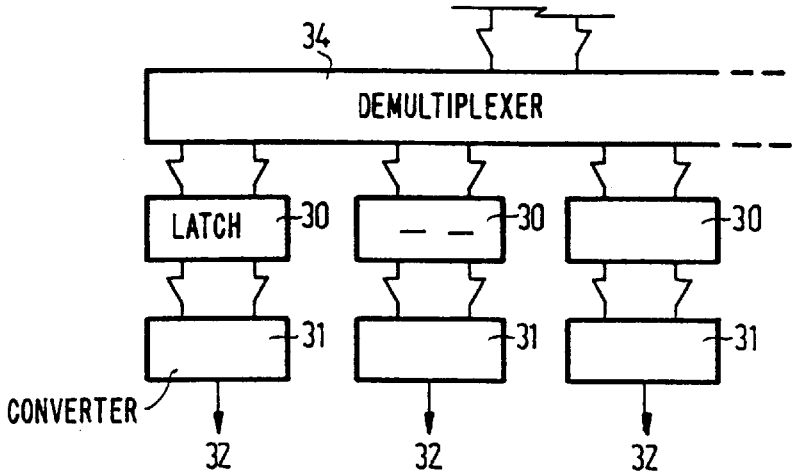

The demultiplexing schemes of FIGS. 3*a* and 3*b* are both intended to be used with a converter circuit 31 of the kind shown in FIG. 4 which inherently incorporates its own latch function. In this way, during the period that the sample from the (n−1)th row is being processed by the digital-to-pulse width converter circuit, data for the nth row can be shifted into the latch circuits 30, i.e., a pipelined operation. In alternative approaches for the digital-to-pulse width converter circuit which do not themselves include a latch function, a second latch will be required in order that the shift register or multiplexer can operate in a pipelined mode.

The function of the switching circuit 32 is to provide each column conductor 19 with a desired voltage level, as determined by the predetermined voltage levels supplied from the circuit 23, at the correct time in a manner which will be described. The timing of this circuit's operation is controlled mainly by the circuit 23 and partly, as will become apparent, by the output from the converter circuit 31.

Writing of video information data signals to the array of display elements is accomplished on a row by row basis where a line of video information is sampled and subsequently written to the display elements in the selected row. The sequence of operations forming one row write cycle consists of three parts.

Firstly, a line of digital video information is sampled and stored by the latch circuits 30 in each stage of the drive circuit 25. This operation is analogous to the action of the sample-and-hold circuits in conventional analogue column driver circuits.

Secondly, each LC display element 12 in the row to be addressed is set to a reference voltage immediately prior to transfer of the video data signals to the display elements. This presetting of the LC display elements is effected by switching appropriate voltages on to the row and column conductors 18, 19 and the common counter electrode 15. This operation occurs each time the row of display elements is addressed and hereafter will be referred to as the resetting phase.

Thirdly, the LC display elements are then given a charge proportional to the value of the digital video sample stored in the latch. For this part of the cycle the time dependent pulse signals from the circuit 32 are applied to the column conductors, and in conjunction with a selection signal applied to their gates, turn on the TFTs associated with the row of display elements for a certain time period according to the digital video sample value. An amount of charge is then stored on the LC display elements which is proportional to the duration of the time dependent pulse signal in the manner to be described below. As there is a single-valued relationship between the transmittance of an LC display element and the charge stored on that cell, the conversion from a digital video sample to an analogue luminance value is complete.

These three parts of the operation cycle are repeated for each row in the array to build up a complete image in one field period.

Figure 5A:
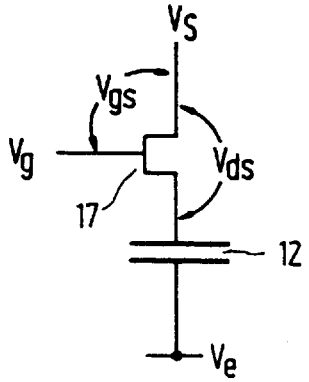
FIGS. 5*a* and 5*b* show respectively the circuit configuration of a typical display element and associated TFT of the display devices, and the I-V operating characteristics of the TFTs used in the display device.
Figure 5B:
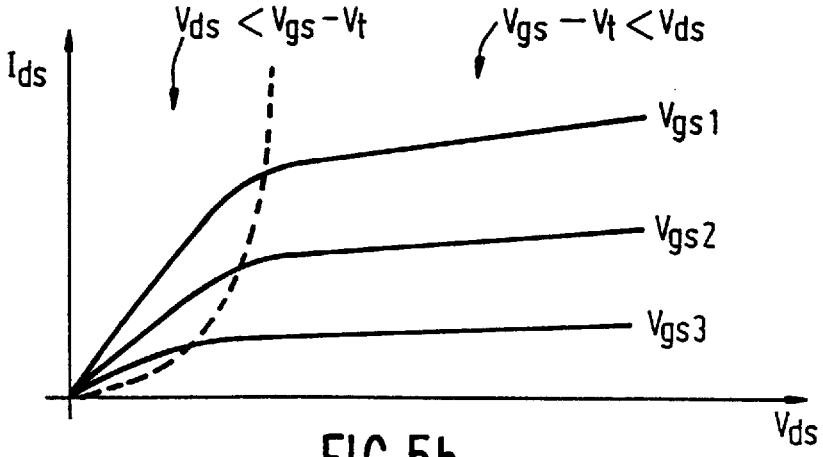

In this operation, the function of the TFTs is to convert a voltage pulse of width determined by the digital-to-pulse width converter circuits to a quantity of charge proportional to the width of the pulse. To achieve this, the TFTs are biased so as to act as a current source, i.e. so that the current flowing in a TFT is determined by the value of the column conductor voltages and gate voltage, and is significantly independent of the drain voltage. The biasing conditions necessary to operate the TFTs in this manner will be described with reference to FIGS. 5*a* and 5*b* in which FIG. 5*a* depicts the circuit configuration of a typical display element and its associated TFT and FIG. 5*b* illustrates graphically the relationship between the drain-source current, Ids, and the drain-source voltage, Vds, of the TFT for different gate-source voltages, Vgs, where Vgs1>Vgs2>Vgs3 and Vgs3>Vt, the TFT's threshold voltage. The region to the right of the dotted line in FIG. 5*b* is the so-called saturation region and it is within this region that the TFTs are operated to achieve current source mode of operation. The current source mode of operation is obtained when $$Vds>Vgs-Vt \quad (1)$$

and in this mode $$Ids=\tfrac{1}{2}\mu Co(Vgs-Vt)^2 \quad (2)$$

where Ids is the drain current, $\mu$ is the effective mobility of the carriers in the TFT channel, and Co is the gate insulator capacitance per unit area.

The region to the left of the dotted line in FIG. 5*b* is the so-called linear, or triode, region (where Vds<Vgs−Vt) and the dotted line itself represents the pinch-off region separating the linear and saturation regions. It should be noted that operating the TFTs in the current source mode is quite different to the normal mode of operating TFTs in active matrix (AM) LC display devices. In conventional TFT type active matrix display devices, the TFTs are operated in the linear region as simple switches.

Equation (2) relates to a situation in which the TFT has an infinite output impedance (Ids is independent of Vds). In practice, the output impedance of the TFT will be of the order of a few M ohms and this will give rise to a slight non-linearity.

In addition to biasing the TFTs for the display elements resetting and charging parts of the operating cycle, the drive waveforms provided by the drive means are contructed so that the display elements are AC driven, that is alternately charged to positive and negative voltages, as is usual to avoid degradation of the LC material.

Figure 6A:
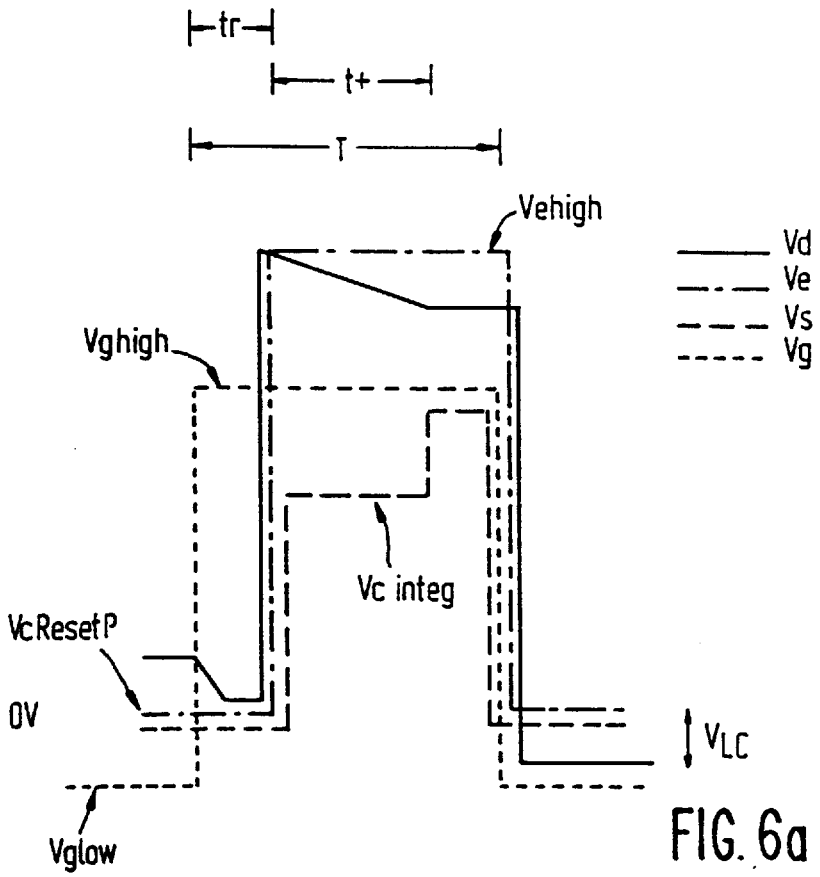
FIGS. 6*a* and 6*b* illustrate typical waveforms and resultant display element voltages present in operation of the display device in one part of its operating cycle.
Figure 6B:
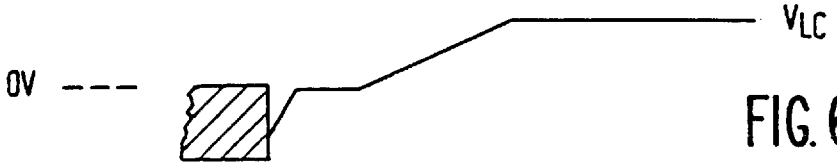
Figure 7A:
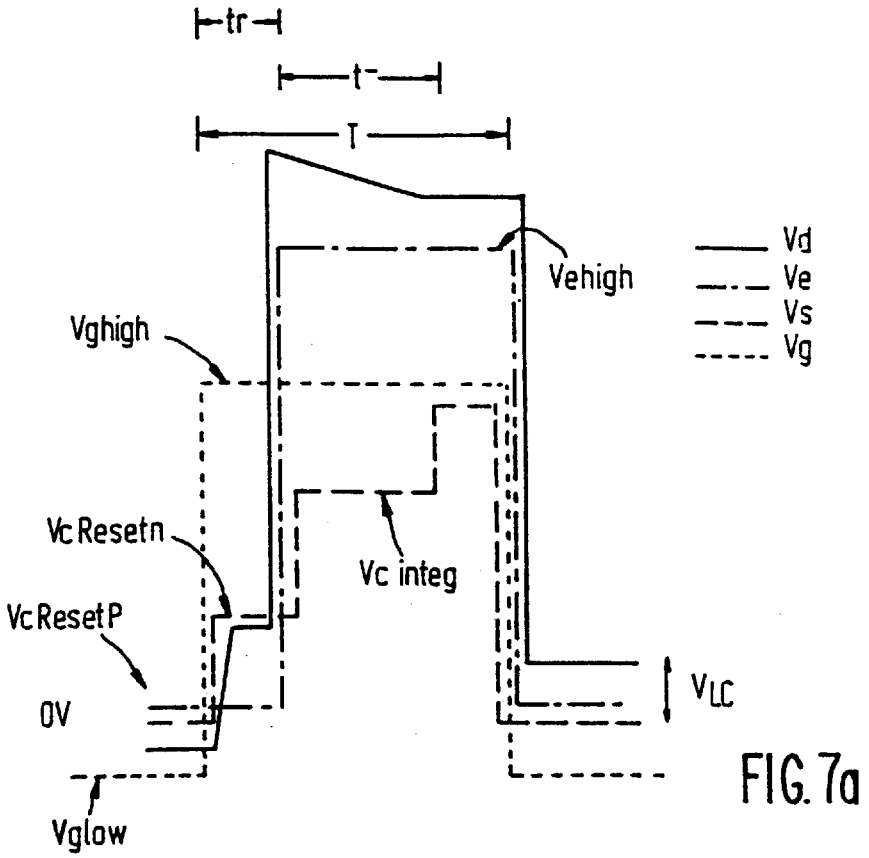
FIGS. 7*a* and 7*b* illustrate waveforms and resultant display element voltages in another part of the operating cycle.
Figure 7B:
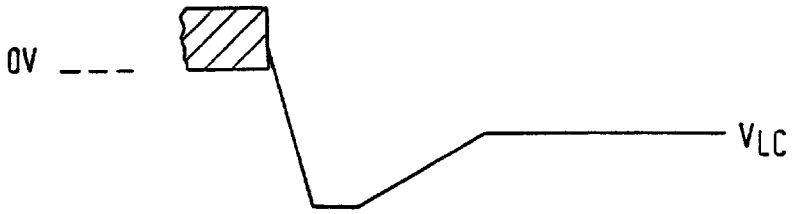

Examples of suitable waveforms provided by the drive means to the sets of row and column conductors and the common electrode for providing the positive and negative alternate charging sequence and waveforms appearing at the display element, are shown respectively in FIGS. 6*a* and 7*a*. The resulting display element voltage, $V_{LC}$, is depicted in FIGS. 6*b* and 7*b* respectively. In the legend accompanying FIGS. 6*a* and 7*a,* Vg denotes the gate voltage, Ve denotes the common electrode voltage, Vs denotes the column conductor (source) voltage and Vd denotes the drain voltage.

In the following description a typical display element in a selected row, that is, a row whose row conductor is supplied with a selection signal from the circuit 21, will be considered. The selection signal, is denoted by Vghigh and is chosen so that the TFTs can be turned on. For all other, un-selected, rows of TFTs, the circuit 21 provides a gate voltage having a lower value, Vglow, sufficient to ensure that those TFTs do not conduct. The selection signals applied to successive row conductors are temporally separate, a series of three such signals for three consecutive rows being depicted schematically in FIG. 2. The duration of the Vghigh signal defines the row selection period, T. Following termination of this signal a similar signal is applied to the succeeding row conductor, and so on.

The write operation begins with the reset phase, occupying the period tr, in which, with the row conductor voltage at Vghigh, the TFT is turned on and the display element is set to a reference voltage according to a voltage, VcResetp, then applied to the column conductor by the voltage switching circuit 32. Prior to this, the drain voltage Vd is at a level in a range of possible levels set in the preceding address period. In the exemplary waveforms illustrated, the reference voltage level is taken to be zero (OV). During this reset phase, the voltage Ve of the common electrode 15 is held at the same reference level, i.e. zero volts, by the circuit 23. In this phase, the TFT is operating in the linear region and behaves as a simple switching element as in conventional display devices.

At the end of the reset phase the display element is ready to be charged to the required level for the desired display effect with the TFT biased as a current source. This biasing results from the timing and control circuit 23 switching the common electrode 15 to a higher voltage Vehigh via the line 22 in FIG. 1 which takes the TFT drain voltage to the same level. At the same time (although for the sake of clarity FIG. 6*a* shows the leading edges being slightly staggered) the column conductor voltage Vs is switched to a higher, preset, level Vcinteg provided by the voltage switching circuit 32 for a period determined by the width of the output pulse from the digital-to pulse width converter circuit 31. This period, denoted by t+, constitutes a charging period and will vary according to the sample digital video signal VDS. Charge is integrated on the display element and at the termination of the signal Vcinteg the column conductor voltage Vs is switched to a level corresponding to Vghigh, i.e. the same as the level of the selection signal (although the levels are shown slightly staggered in FIG. 6*a*), for the remainder of the row selection period T to turn the TFT off. Again for the sake of clarity, the trailing edges of the signals are shown in FIG. 6*a* as being slightly staggered but in practice they are substantially simultaneous.

Provided that at the beginning of the charging period t+

$$Vehigh=Vd>Vghigh-Vt \quad (3)$$

and that at the end of the charging period $$Vehigh-V_{LC}=Vd>Vghigh-Vt \quad (4)$$

where $V_{LC}$ is the voltage on the display element, the TFT remains biased as a current source and provides a linear charging characteristic during this period. At the end of the charging period, as determined by the duration of the pulse width modulated signal from the circuit 31, the TFT turns off for the remainder of the row selection period and is thereafter held off while all other rows are addressed and until that row is next addressed in the subsequent field by virtue of the row conductor being at Vglow, with the charge being stored on the display element for this (field) period. FIG. 6*b* illustrates the display element voltage $V_{LC}$ during this operation. At the beginning, $V_{LC}$ can have a range of values as set in the previous row selection period, which range is represented in FIG. 6*b* by the hatched block. Following the reset phase, charge is integrated in the display element during the charging period and at the end of this period an amount of charge is stored on the display element which is dependent on the fixed level of Vcinteg and the duration of the period t+. The display element can be charged to a level in a continuous range of levels according to the duration of Vcinteg with its final value being dependent on the time element of the time dependent signal.

The other display elements in the same row are similarly addressed, according to their respective pulse width signals, at the same time. The subsequent rows of display elements are addressed in the same fashion, one at a time, with the TFTs associated with previous rows being held off by the non-selection voltage Vglow.

The operation when next addressed in a row selection period in the subsequent field for negative charging of the display element, as shown in FIGS. 7*a* and 7*b,* is similar to that described above except that a difference occurs during the reset phase. Given the required TFT biasing condition to act as a current source, the drain current during the charging phase is unipolar, that is, the current flows into the TFT's drain, and consequently the charging direction of the display element is similarly unipolar. For AC driving of the display element the reset voltage given to the display element must now, for negative charging, be a negative voltage greater than the largest voltage required on the display element (i.e. greater than the liquid crystal saturation voltage).

To this end the column conductor voltage is set to a value VcResetn, and the common electrode voltage Ve is set, as previously, to VcResetp during the reset phase tr. With the TFT operating in the linear region during this phase, the voltage then appearing on the display element at the end of the reset phase is given by $$V_{LC}=VcResetp-VcResetn \quad (6)$$

Thereafter, during the charging phase t, with the TFT biased to operate as a current source, the display element is charged in the positive direction, as before, but at the end of the charging period t−, determined by the width of the pulse signal from the converter circuit 31, the display element still carries a negative charge, as is apparent from FIG. 7*b*. The level of this charge will vary according to the duration, t−, of the pulse signal to provide their required display effect.

The charge integration periods t+ and t− need not be continuous as described above but instead may comprise a plurality of discrete sub-periods whose total duration corresponds to t+ or t−.

Certain signal pre-processing may be desirable. For example, some video signal processing may be required to allow for the non-linear charging versus transmittance characteristic of the display elements. This processing of the video signal is accomplished prior to supply of the video signal to the drive means 20 using a video signal processing circuit as indicated at 50 in FIG. 1. An additional processing operation arises from the AC operation of the display elements. During the positive display element charge cycle (FIG. 6*b*) the final charge on the display element is proportional to the digital video sample, VDS, (when the positive cycle reset level value is zero). In the negative cycle (FIG. 7*b*), however, the display element is reset to a negative value and the TFT current charges the element towards zero with the amplitude of the display element voltage $V_{LC}$ decreasing with increasing t−. Hence, if tvid is the charging time corresponding to a given video signal and tmax is the maximum charging time (tmax=T−tr), then t+ and t− are given by $$t+=tvid \quad (7)$$

$$t-=tmax-tvid \quad (8)$$

The digital video data signal fed to the converter circuit 31 of a stage of the circuit 25 should, therefore, be coded in an appropriate way such that the digital value, Npw, (where N is a number representing the value of the sample) generates different column data signals from the circuit 31 for the two polarities. During the positive cycle $$Npw=Nvid \quad (9)$$

and during the negative cycle, $$Npw=Nmax-Nvid \quad (10)$$

where Nmax is the maximum possible video signal sample value.

Figure 8:
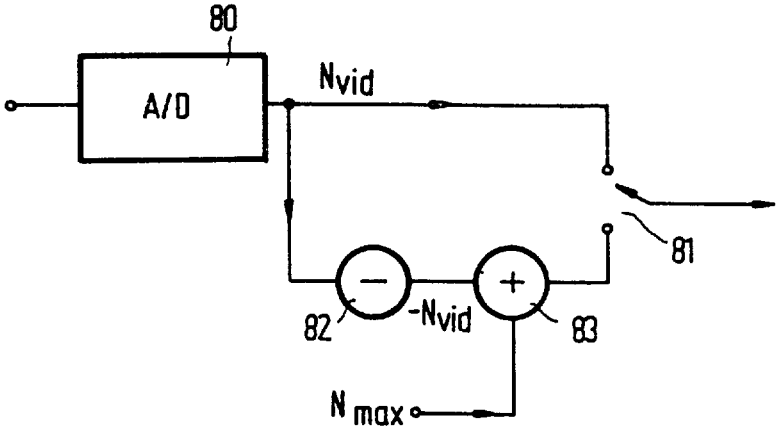
FIG. 8 shows schematically a signal processing circuit which can be used in the display device.

FIG. 8 shows schematically a digital processing circuit, comprising part of the video signal processing circuit 50, by which the required correction can be achieved. The input video signal may be a digital or an analogue video signal and in that latter case an A/D converter 80 is included. The digital video signal, Nvid, typically 3 to 8 bits in length, is supplied via a first branch to a column signal inversion change-over switch 81 and also via an inverter 82 to an adder 83 where it is added to Nmax to obtain Nmax−Nvid which is then supplied to the change over switch 81. The switch 81 is operated at field frequency so that Nvid and Nmax−Nvid are supplied in alternate field periods to the data signal drive circuit 25 for the positive and negative drive cycles respectively.

Figure 9:
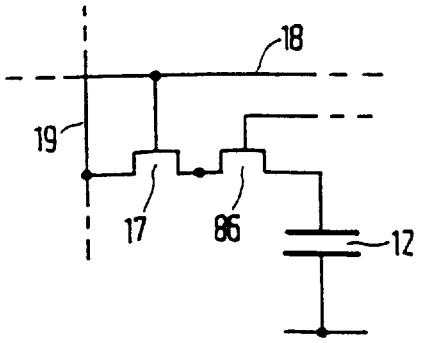
FIG. 9 shows schematically the circuit configuration of a typical display element and associated TFTs in a modification of the display device.

The output impedance of the TFTs 17 biased as current sources can be increased if necessary by the addition of a cascode device, as shown in FIG. 9 which illustrates the circuit configuration of a typical display element in which the cascode device, comprises a further TFT 86 connected in series with the TFT 17 between the display element 12 and the column conductor 19. The effect of the cascode device is to decrease the variation in drain voltage that the TFT 17 experiences as a result of changes in the output voltage, thereby increasing the output impedance by a factor gm2/go2 where gm2 and go2 respectively are the mutual conductance and the output conductance of the TFT 86. For simplicity the gate of the TFT 86 can be biased at a fixed potential.

The drive circuits 21 and 25 can readily be constructed using TFTs and may therefore be conveniently integrated on the same substrate as the array of TFTs 17, and the sets of address conductors 18 and 19, with the array of TFTs 17 and the drive circuits being formed simultaneously by common processing, using for example poly-silicon TFTs. Such an arrangement is depicted in FIG. 1.

The display device can be a full colour display device in which a colour micro-filter array is provided for the display element array. In this case, the video signal is supplied as three separate digital signals, R, G and B, along three buses to the data signal drive circuit 25 which is suitably adapted by having three latch circuits 30 in each stage whose outputs are individually switched to the converter circuit 31.

Applications for the display device include those where video information exists in a digital form, for example in the CD-I environment, or in datagraphic displays, and in display systems (supplied with either analogue or digital information). In a display device with drive circuits integrated on to the display it may be easier to implement a fully digital circuit as described than a conventional analogue circuit.

Although the display device described above comprises a liquid crystal display device, it is envisaged that other electro-optical material can be employed, for example electroluminescent or electrochromic materials.

From reading the present disclosure, other modifications will be apparent to persons skilled in the art. Such modifications may involve other features which are already known in the field of active matrix display devices and their method of operation and which may be used instead of or in addition to features already described herein.

We claim:

1. A method of driving an active matrix display device having sets of row and column conductors and an array of display elements each comprising first and second electrodes with electro-optical material therebetween, the first electrodes being connected to the drain of a respective TFT whose source and gate are connected respectively to a column and a row conductor, in which selection signals are applied to the row conductors and in which video information signals are converted into corresponding time dependent signals, characterised in that the time dependent signals are applied to the column conductors and in that during the application of a selection signal to a row of TFTs the TFTs are biased to act as current sources such that their associated display elements are charged to a level dependent on the duration of the applied time dependent signal.

2. A method according to claim 1, characterised in that the TFTs are biased to act as current sources by switching the potential applied to the second electrode of the display elements connected thereto to a level which is greater than the difference between the level of the selection signal applied to their gates and their threshold voltage level.

3. A method according to claim 2, characterised in that the period for which the bias level is applied is at least equal to the maximum duration of the time dependent pulse signal and in that the column conductor is switched to a voltage level substantially corresponding to the level of the selection signal for the remaining duration of the bias level.

4. A method according to claim 3, characterised in that the application of the bias level is terminated substantially simultaneously with the selection signal.

5. A method according to claim 4, characterised in that during a first part of the selection signal and prior to said biassing of the TFTs the display elements of the row concerned are reset to a predetermined level by applying a reset voltage to the column conductors.

6. A method according to claim 2, characterised in that during a first part of the selection signal and prior to said biassing of the TFTs the display elements of the row concerned are reset to a predetermined level by applying a reset voltage to the column conductors.

7. A method according to claim 3, characterised in that during a first part of the selection signal and prior to said biassing of the TFTs the display elements of the row concerned are reset to a predetermined level by applying a reset voltage to the column conductors.

8. A method according to claim 1, characterised in that during a first part of the selection signal and prior to said biassing of the TFTs the display elements of the row concerned are reset to a predetermined level by applying a reset voltage to the column conductors.

9. A method according to claim 8, characterised in that the reset voltage alternates between two levels for successive fields such that the display elements are charged to positive and negative voltages in alternate fields.

10. An active matrix display device comprising sets of row and column conductors, an array of display elements each comprising first and second electrodes with electro-optical material therebetween, the first electrodes being connected to the drain of a respective TFT whose source and gate are connected respectively to a column and a row conductor, and a drive circuit for driving the display elements comprising a scan drive circuit for applying selection signals to the row conductors and a data signal drive circuit connected to the column conductors which includes means for providing time dependent pulse signals representing video information, characterised in that the data signal drive circuit is arranged to supply the time dependent pulse signals to the column conductors and in that the data signal drive circuit includes means for biasing the TFTs during the application thereto of a selection signal such that the TFTs act as current sources.

11. A device according to claim 10, characterised in that the drive circuit includes a voltage control circuit connected to the second electrodes of the display elements for applying to the second electrodes during the application of the selection signals to their associated TFTs a voltage level at which the TFTs are biased to act as current sources.

12. A device according to claim 11, characterised in that the drive circuit is operable to apply a predetermined potential to the column conductors in a first part of the selection signals to charge the display elements to a predetermined level and to apply the time dependent pulse signals during a second part of the selection signals.

13. A device according to claim 11, characterised in that the data signal drive circuit comprises a digital-to-pulse width converter circuit for converting input digital video signals to corresponding pulse width signals.

14. A device according to claim 11, characterised in that the data signal drive circuit, the sets of row and column conductors and the TFTs are carried on a common support.

15. A device according to claim 10, characterised in that the drive circuit is operable to apply a predetermined potential to the column conductors in a first part of the selection signals to charge the display elements to a predetermined level and to apply the time dependent pulse signals during a second part of the selection signals.

16. A device according to claim 15, characterised in that the data signal drive circuit includes a voltage switching circuit connected between the output of the converter circuit and the column conductors which is operable to apply said time dependent pulse signals and said predetermined potential to the column conductors and in that the drive circuit includes a timing and control circuit for supplying voltages and timing signals to the voltage switching circuit for operating the voltage switching circuit.

17. A device according to claim 16, characterised in that the data signal drive circuit, the sets of row and column conductors and the TFTs are carried on a common support.

18. A device according to claim 15, characterised in that the data signal drive circuit comprises a digital-to-pulse width converter circuit for converting input digital video signals to corresponding pulse width signals.

19. A device according to claim 15, characterised in that the data signal drive circuit, the sets of row and column conductors and the TFTs are carried on a common support.

20. A device according to claim 10, characterised in that the data signal drive circuit comprises a digital to pulse width converter circuit for converting input digital video signals to corresponding pulse width signals.

21. A device according to claim 20, characterised in that the data signal drive circuit includes a voltage switching circuit connected between the output of the converter circuit and the column conductors which is operable to apply said time dependent pulse signals and said predetermined potential to the column conductors and in that the drive circuit includes a timing and control circuit for supplying voltages and timing signals to the voltage switching circuit for operating the voltage switching circuit.

22. A device according to claim 20, characterised in that the data signal drive circuit, the sets of row and column conductors and the TFTs are carried on a common support.

23. A device according to claim 10, characterised in that the data signal drive circuit, the sets of row and column conductors and the TFTs are carried on a common support.

* * * * *